United States Patent [19]

Mima

[11] 4,292,796

[45] Oct. 6, 1981

[54] PNEUMATIC YARN SPLICING APPARATUS

[75] Inventor: Hiroshi Mima, Joyoshi, Japan

[73] Assignee: Murata Kikai Kabushiki Kaisha, Japan

[21] Appl. No.: 118,856

[22] Filed: Feb. 5, 1980

[30] Foreign Application Priority Data

Feb. 9, 1979 [JP] Japan ..... 54-14607

[51] Int. Cl.[3] ..... D01H 15/00

[52] U.S. Cl. ..... 57/22; 57/261

[58] Field of Search ..... 57/22, 23, 261, 263, 57/264, 202; 242/35.6 R

[56] References Cited

U.S. PATENT DOCUMENTS

| | | | |
|---|---|---|---|
| 4,002,012 | 1/1977 | Norris et al. | 57/22 |
| 4,002,013 | 1/1977 | Johnson et al. | 57/22 |
| 4,232,509 | 11/1980 | Rohner et al. | 242/35.6 R X |
| 4,240,247 | 12/1980 | Matsui et al. | 57/22 X |
| 4,246,744 | 1/1981 | Matsui et al. | 57/22 |

*Primary Examiner*—Donald Watkins

*Attorney, Agent, or Firm*—Whittemore, Hulbert & Belknap

[57] ABSTRACT

Apparatus and method for splicing the ends of spun yarn by inserting the yarn ends into two air jet nozzles, in which they are doubled and subjected to an air jet to join them each other. Yarn end cutting and holding devices for the top yarn and the bottom yarn and automatic yarn inserting devices are disposed at each end of the jet nozzles.

3 Claims, 5 Drawing Figures

PNEUMATIC YARN SPLICING APPARATUS

FIELD OF THE INVENTION

The present invention relates to a pneumatic yarn splicing method and apparatus and specially relates to the method and apparatus for a spun yarn.

The ends of two yarns are introduced into an air nozzle and both the yarn ends are subjected to the action of a swiring stream of air jetted from the air nozzle, whereby both the yarn ends are joined together.

BACKGROUND OF THE INVENTION

According to conventional pneumatic yarn splicing method, so-called false twists are imparted to the doubled portion of yarns by a swiring stream of jetted air and in this state, the yarn splicing operation is accomplished. Therefore, S twists are given to one end of the joined portion of yarn and Z twists are given to the other end of the joined portion. Furthermore, twists in a certain direction are given to spun yarn by the spinning operation. Accordingly, on one end of the joined portion, the direction of inherent twists of the yarn is opposite to the direction of twists given by the air nozzle, and in this end portion where twists of opposite compositions are given, fluffs are readily formed and the yarn tenacity is reduced.

SUMMARY OF THE INVENTION

An object of the present invention is to provide a method and apparatus for splicing yarn ends of the spun yarn to produce a spliced yarn having uniformly twisted joint on each side of the yarn-joined portion.

Another object of the present invention is to provide a spliced yarn wherein breakage of the yarn-joined portion is hardly caused even if the yarn-joined portion is drawn from the upper or lower side at the knitting or meaving step.

According to the present invention, uniform and stable yarn-joined portions can be obtained.

Other a farther object, features and advantages of the invention will appear more fully from the following description.

DETAILED DESCRIPTION OF THE INVENTION

The present invention will now be described in detail with reference to the accompanying drawings.

Figure 1:
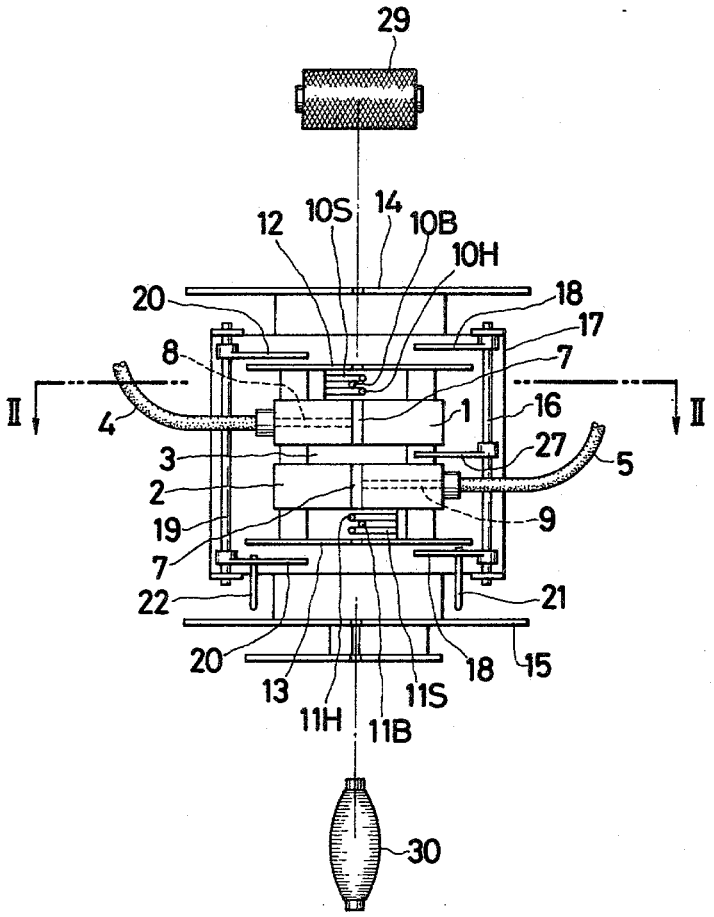
FIG. 1 is a front view illustrating the apparatus of the present invention.
Figure 2:
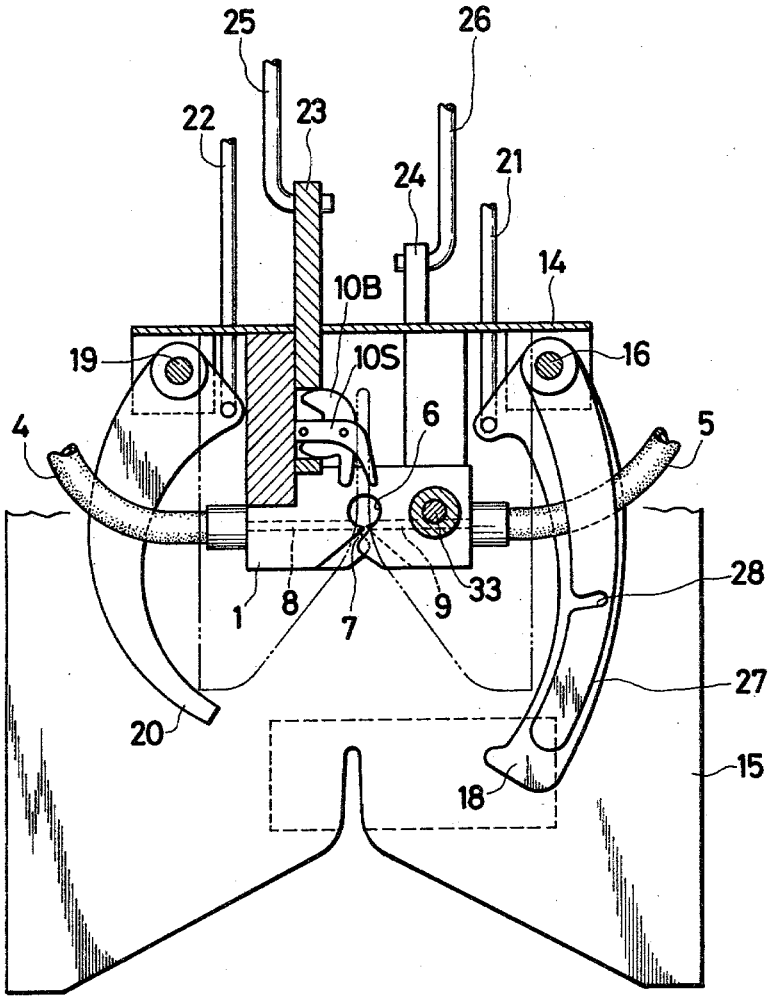
FIG. 2 is a view showing the section taken along the line II—II in FIG. 1.

Referring to FIGS. 1 and 2, air nozzles 1 and 2 are disposed to produce jetted air streams swirling in directions opposite to each other and they are arranged in parallel to each other so that a small space 3 is formed therebetween. Pipes 4 and 5 are laid out to supply compressed air to the nozzles 1 and 2. The nozzles 1 and 2 have similar structures, and they have a hole 6 and a yarn-inserting slit 7 communicated with the hole 6. The nozzles 1 and 2 have jetting pipes 8 and 9 extended from the compressed air pipes 4 and 5 toward the hole 6 in the tangetial direction thereto, respectively. In the embodiment shown in FIG. 2, air jetted from the jetting pipe 8 into the hole 6 forms a swirling air stream swirling in the counterclockwise direction in the hole 6 and air jetted from the jetting pipe 9 into the hole 6 forms a swirling air stream swirling in the clockwise direction in the hole 6.

Yarn end cutting and holding devices 10 and 11 are disposed above the nozzle 1 and below the nozzle 2, respectively, and yarn guide plates 2 and 3 are arranged above the yarn end cutting and holding device 10 and below the yarn end cutting and holding device 11, respectively. Each of the yarn end cutting and holding devices 10 and 11 comprises a bill head 10H or 11H, a bill blade 10B or 11B and a bill spring 10S or 11S. The bill heads 10H and 11H, and the bill springs 10S and 11S are fixed to each other through a screw and a pin. The bill blades 10B and 11B are arranged rotatably to the bill heads 10H and 11H, and bill springs 10S and 11S through the pin. When the bill blade 10B is closed, the yarn is cut between the bill blade 10B and bill spring 10S and the cut yarn end is held between the bill blade 10B and bill head 10H. Furthermore, another yarn guide plates 14 and 15 are arranged above the yarn guide plate 12 and below the yarn guide plate 13, respectively. A yarn presser 18 supported pivotably on a supporting frame 17 by a shaft 16 is arranged between the yarn guide plates 12 and 14 and a yarn presser 20 supported pivotably on the supporting frame 17 by a shaft 19 is arranged between the yarn guide plates 13 and 15. The yarn pressers 18 and 20 are turned by knotter cams (not shown) through a rod 21 and a rod 22, respectively. Operation pieces 23 and 24 are disposed to open and close the yarn end cutting and holding devices 10 and 11, and the operation pieces 23 and 24 are acutated by the knotter cams through a rod 25 and a rod 26, respectively. An intermediate lever 27 is supported on the shaft 16 rotatably integrally with the yarn presser 18, and this intermediate lever 27 is arranged in the above-mentioned space 3 and has a yarn inserting slit 28 formed at the position confronting the nozzle hole 6. Reference numerals 29 and 30 represent a winding package and a yarn supplying bobbin, respectively.

Figure 3:
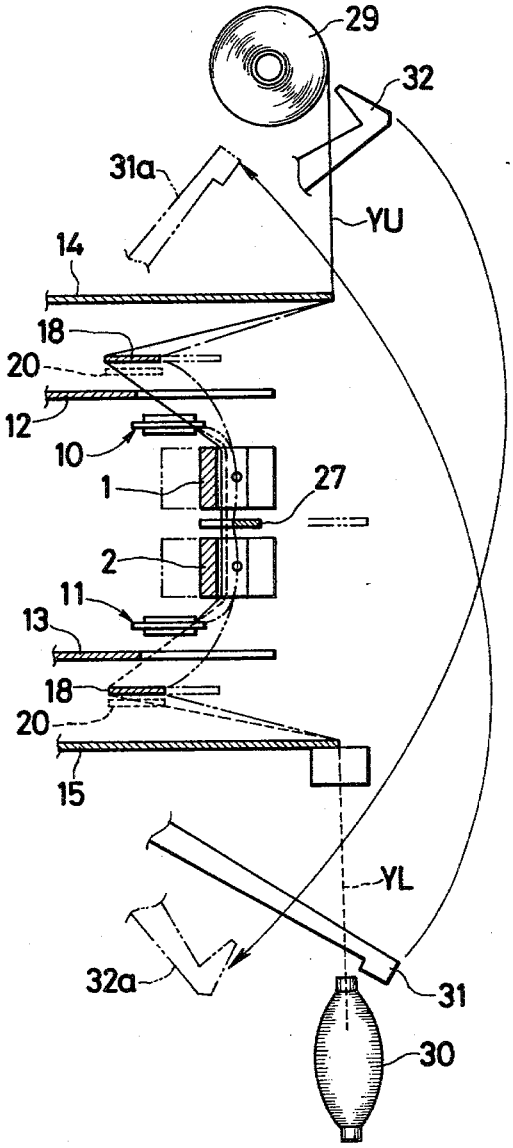
FIG. 3 is a side view, partly in section, showing the positional relationship of respective elements of the apparatus of FIG. 2.

The arrangement, seen from the side of the above-mentioned structural elements is shown in FIG. 3. The operations of the respective elements will now be described with reference to FIG. 3.

In the explation given hereinafter, upper and lower yarns are inserted into the nozzle hole 6 and yarn end cutting and holding devices 10 and 11 through a V-shaped guide face defined by the guide plates 12, 13, 14 and 15 and a slit formed on the apex of the V-shaped guide face.

(a) A relay pipe 31 is turned to a position 31*a* indicated by a chain line while it sucks and holds the end of the yarn from the bobbin 30, and the lower yarn YL is inserted between the guide plates 14 and 15.

(b) The yarn presser 20 is turned in the counterclockwise direction in FIG. 2 to a position indicated by a dot line in FIG. 3 in the state where the yarn end cutting and holding device 10 is opened but the yarn end cutting and holding device 11 is closed, and the lower yarn UL is introduced into the device 10 and the holes 6 of the nozzles 1 and 2. The lower yarn YL is transferred to the yarn presser 18 from the yarn presser 20 at the subsequent step, but at this point, the lower yarn YL is bent by the yarn presser 20.

(c) A suction mouth 32 is turned to a position 32*a* indicated by a chain line while it sucks and holds the end of the yarn of package 29, and the upper yarn YU is inserted between the guide plates 14 and 15.

(d) The yarn end cutting and holding device 10 is closed, and the end of the lower yarn YL is cut and held by the device 10.

(e) In the state where yarn end cutting and holding device 10 is closed but the yarn end cutting and holding device 11 is opened, the yarn presser 18 is turned in the clockwise direction in FIG. 2 to a position indicated by a solid line in FIG. 3, and the upper yarn YU is introduced into the device 11 and the holes 6 of the nozzles 1 and 2.

(f) The yarn end cutting and holding device 11 is closed, and the end of the lower yarn YL is cut and held by the device 11.

(g) The yarn presser 20 is returned to the position shown in FIG. 2, and the lower yarn YL indicated by a dot line in FIG. 3 separates from the yarn presser 20 and is pressed by the yarn presser 18 instead. Thus, the upper and lower yarns YU and YL are held as indicated by the solid line and dot line, respectively, in FIG. 3.

Figure 4:
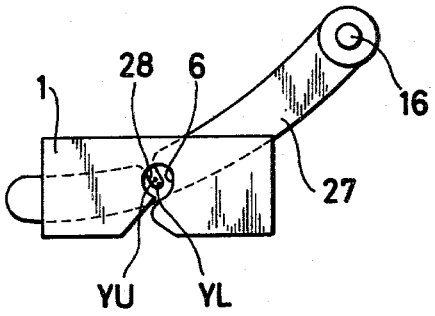
FIG. 4 is a view showing the positional relationship between the nozzle and intermediate lever during the yarn-splicing operation.

In this state, the intermediate lever 27 integral with the yarn presser 18 is located between the holes 6 of the nozzles 1 and 2 as indicated by a solid line in FIG. 3. This state is illustrated also in FIG. 4, and as apparent from FIG. 4, the total peripheries of the yarns YU and YL are surrounded by the holes 6 and yarn inserting slit 28.

(h) In the above-mentioned state, the yarn presser 18 is slightly retreated to a position indicated by a chain line in FIG. 3 so that the lower and upper yarns YL and YU having the one ends held by the yarn end cutting and holding devices 10 and 11, respectively, are slightly slackened. Substantially simultaneously, compressed air is jetted into the holes 6 through the jetting pipes 8 and 9, the above-mentioned air streams swirling in the opposite directions act on the doubled portion of the slightly slackened upper and lower yarns to effect joining of the upper and lower yarns. In the above explanation, the yarn presser 18 is retreated to slacken the yarns. Instead of this method, there may be adopted a method in which the yarn presser 18 is fixed at the position indicated by the solid line in FIG. 3 and the nozzles 1 and 2 are supported on a shaft 33 and are moved to a position indicated by a chain line in FIG. 3.

Figure 5:
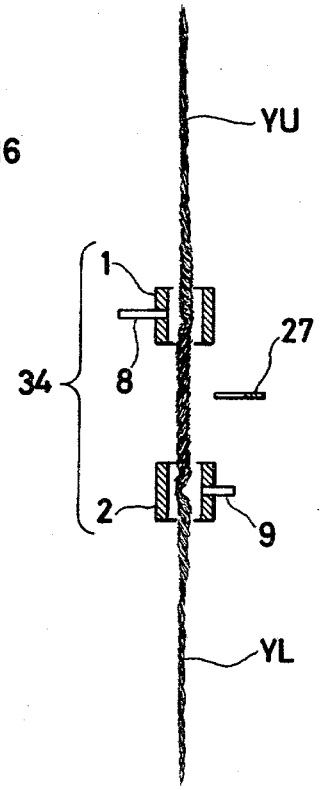
FIG. 5 is a diagram illustrating the main apparatus of the present invention and spliced yarn.

The false twisting action by the above-mentioned swirling air streams is illustrated in FIG. 5. The swirling directions of the air streams from the nozzles 1 and 2 are set in the above-mentioned manner when the inherent twists on the yarn of the yarn supplying bobbin 30 are S twists. The yarn-joined portion covers a range indicated by 34 in FIG. 5, and S twists appear above the jetting pipe 8 of the nozzle 1 and 2 twists appear below the jetting pipe 8 of the nozzle 1 while Z twists appear above the jetting pipe 9 of the nozzle 2 and S twists appear below the jetting pipe 9 of the nozzle 2. Accordingly, twists appearing on both the sides of the yarn-joined portion are S twists and the twist direction is in agreement with the twist direction of the yarns YL and YU. Therefore, a well-agreed twisting condition is attained on each side of the yarn-joined portion and the yarn-joined portion looks like one yarn. Even if the so formed yarn-joined portion is drawn from the upper or lower side, no resisting force is produced. Accordingly, breakage of the yarn-joined portion is hardly caused at the knitting or weaving step. Moreover, the yarn-joined portion does not become a defect of the yarn appearance.

When the inherent twists of the yarn are Z twists, the directions of the swirling air streams from the nozzles 1 and 2 should be reversed to the above-mentioned directions.

(i) The yarn presser 18 is returned to the position indicated in FIG. 2, and winding of the yarn is started again.

The above-mentioned operation (a) to (i) are conducted in sequence and the yarn-splicing operation is completed.

In the present invention, as described hereinbefore, even if the yarn-joined portion is drawn from the upper or lower side at the knitting or weaving step, breakage of the yarn-joined portion is hardly caused, and the yarn-joined portion does not become a defect of the yarn appearance. Furthermore, in the present invention, since nozzles 1 and 2 are arranged with a space 3 formed therebetween, swirling air streams from the nozzles 1 and 2, which swirl in directions opposite to each other, do not interfere with each other at all and the false twisting operation can be performed in good conditions. Furthermore, the yarn being turned is pressed by the yarn inserting slit 28 and flase twists imparted by the nozzles 1 and 2 are prevented from shifting by the pressed portion. Accordingly, uniform and stable yarn-joined portions can always be obtained according to the present invention.

What is claimed is:

1. Yarn splicing apparatus comprising a yarn end cutting and holding device for the lower yarn end, a yarn end cutting and holding device for the upper yarn end, two air jet nozzles having an elongated yarn inserting hole into which spun yarn ends are introduced, said air jet nozzles being arranged between the yarn end cutting and holding devices so that a space is formed between the two air jet nozzles, and air jet means communicating with the hole to create a swirling air stream, wherein said air nozzles are disposed to produce jetted air streams swirling in directions opposite to each other in the respective holes.

2. Yarn splicing apparatus as claimed in claim 1, including an intermediate lever which has a yarn inserting slit formed at the position confronting the holes of the air jet nozzles, said lever being arranged rotatably in the space between the two air jet nozzles.

3. Yarn splicing method for a spun yarn comprising the steps of introducing an upper yarn end and lower yarn end into a yarn end cutting and holding device for the lower yarn end, two air nozzles for applying air stream and a yarn end cutting and holding device for the upper yarn end, cutting and holding each of the yarn end respectively, slightly slackening the doubled portion of the introduced yarns into the air nozzles and applying air streams swirling in directions opposite to each other within the respective air nozzles.

* * * * *